US006597982B1

(12) United States Patent
Schmidt

(10) Patent No.: US 6,597,982 B1
(45) Date of Patent: Jul. 22, 2003

(54) METHOD FOR CODING CONGESTION AFFECTING SEVERAL TRAFFIC LANES

(75) Inventor: Heinrich Schmidt, Diekholzen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,595

(22) PCT Filed: Jun. 28, 2000

(86) PCT No.: PCT/DE00/02097

§ 371 (c)(1),
(2), (4) Date: Jun. 15, 2001

(87) PCT Pub. No.: WO01/06478

PCT Pub. Date: Jan. 25, 2001

(30) Foreign Application Priority Data

Jul. 20, 1999 (DE) ..... 199 33 970

(51) Int. Cl.[7] ..... G08G 1/00
(52) U.S. Cl. ..... 701/117
(58) Field of Search ..... 701/1, 23–26, 701/200, 117–120; 340/993, 996; 455/3.01–3.04, 3.06; 370/345, 349–350, 466–472, 474

(56) References Cited

U.S. PATENT DOCUMENTS 4,519,068 A * 5/1985 Krebs et al. ..... 370/329
4,907,159 A * 3/1990 Mauge et al. ..... 701/117
5,991,610 A * 11/1999 Ruhl et al. ..... 455/186.1
6,438,561 B1 * 8/2002 Israni et al. ..... 455/457

FOREIGN PATENT DOCUMENTS

| | | |
|---|---|---|
| DE | 197 53 050 | 8/1998 |
| EP | 0 725 502 | 8/1996 |
| EP | 0 795 974 | 9/1997 |

OTHER PUBLICATIONS

Van Coile et al., *Speech Synthesis For The New Pan–European Traffic Message Control System RDS–TMC,* Speech Communication, NL, ELSEVIER Science Publishers, Amsterdam, Bd. 23, Nr. 4, Dec. 1, 1997.*

* cited by examiner

*Primary Examiner*—Thu Nguyen
(74) *Attorney, Agent, or Firm*—Kenyon & Kenyon

(57) ABSTRACT

In a method for coding traffic hindrances encroaching on the street, in digitally coded traffic messages which contain, as elements, a location on a street and the extent and the direction of the traffic hindrance and which are decoded on the basis of a location table, in reported traffic hindrances that extend, based on their size, beyond a junction onto a different street, a further element codes the information, on which of the bifurcating streets, in which direction, and how far, the reported traffic hindrance extends.

6 Claims, 1 Drawing Sheet

| 3 bit | 1 bit | 4 bit | 3 bit | 1 bit | 4 bit |
|---|---|---|---|---|---|
| SELECT1 | D1 | EXTENT1 | SELECT2 | D2 | EXTENT2 |
| 2 | 0 | 4 | 2 | 0 | 1 |

METHOD FOR CODING CONGESTION AFFECTING SEVERAL TRAFFIC LANES

FIELD OF THE INVENTION

The invention relates to a method for coding traffic hindrances that encroach upon the street, in digitally coded traffic messages which contain as elements a location situated on a street and the extent and direction of the traffic hindrance, and which are decoded on the basis of a location table or a digital map.

BACKGROUND INFORMATION

A design of this type and a coding of this type of traffic message is established, by way of example, in the CEN EN 12313-1, which is based on the draft code ALERT C, November 1990, published by the RDS ATT ALERT Consortium. Thus using the radio-data system (RDS), an additional and inaudible transmission of digital data is possible in a data channel parallel to radio programs. In this context, the essential elements of a traffic message are the location of the event and the event. This data is cataloged, which means that each traffic-relevant location and each traffic-relevant event is assigned a unique code. Linking the locations in a location table along existing streets describes the pattern. In order to exploit the traffic message channel (TMC), in addition to the customary devices of a receiving apparatus having an RDS decoder, devices for decoding, storing, processing, and outputting the traffic messages are necessary.

Digitally coded traffic messages—hereinafter also termed TMC messages, for the sake of simplicity—can be transmitted not only using the radio-data system, but also, for example, within the digital audio broadcast (DAB), especially in an FI channel (Fast Information Channel). In addition, transmission of messages over mobile telephony networks is provided, the broadcast channel and the SMS channel (Short Message Service) being suitable for this purpose. Currently, in this regard, a Global Automotive Telematic Standard (GATS) is being worked out. This is a packet-oriented data channel, which can be processed parallel to a voice telephone call. Whereas, in the radio systems, i.e., in uni-directional networks, all TMC messages are transmitted one after the other, in bidirectional networks transmission is possible upon request.

In a TMC message, only one location code is transmitted in each case. In order to be able to calculate the end point of a traffic hindrance, the direction and the extent of the traffic hindrance are also transmitted. The extent indicates how many segments of a street are affected by the traffic hindrance. The direction indicates in which direction the end point of the traffic hindrance lies. In this context, all locations affected must be on the same street.

References to other streets only come about as a result of the fact that a linkage of the streets (Intersection Code) is generated at the level of the location, reference being made in the intersection code to the location of the intersecting streets, which are also coded in the location table. This intersection code heretofore has only aided in realizing navigational applications within the location table and in checking the plausibility of the location table itself. If the traffic hindrances affect more than one street, they can only be coded in the known method by generating a plurality of messages—one for each of the streets in question.

SUMMARY OF THE INVENTION

The objective of the present invention is to code traffic hindrances based on the location table so that traffic hindrances that extend over more than one street can also be decoded and reproduced in a form that is easy to absorb by the user.

This objective is achieved in the method according to the present invention as a result of the fact that in the case of reported traffic hindrances, which, due to their size, extend beyond a junction and onto a different street, a further element is used to code the information, on which of the bifurcating streets, in which direction, and how far, the reported traffic hindrance extends.

The present invention can be applied to junctions and intersections, the term junction being used throughout to describe the present invention, because an intersection can also be considered as a multiple junction.

In the TMC system that is standard throughout Europe, the method according to the present invention can be applied through the fact that the digital coding of the traffic messages takes place in accordance with the ALERT-C protocol, and that the additional element is label 12.

As a result of the present invention, a higher percentage of existing traffic messages is accessible to direct coding. In contrast to splitting up the information in a plurality of messages, the messages that are generated in this manner are easier to register, they generally reduce the channel capacity required, and they therefore increase the attractiveness of the RDS-TMC system for operators and users.

The method according to the present invention is compatible with existing data terminals in the sense that no false information is generated. Receivers that cannot interpret label 12 receive a reduced scope of information on the cause of the disturbance and receive a partial range of the routes affected by the disturbance.

It is especially advantageous to apply the method according to the present invention in expanding the RDS-TMC system to urban areas where traffic hindrances encroaching upon the street are a regular occurrence, as a result of which the currently used protocol operates at its limits.

One advantageous embodiment of the method according to the present invention lies in the fact that the data field of label 12 contains three bits for the selection of the street connecting to the junction on which the traffic hindrance is located, one bit for the relevant direction, four bits for the extent of the hindrance on this street, and in the fact that eight further bits for identical coding are provided in the event that the traffic hindrance also extends beyond a further street change. In this context, it can be preferentially provided that when the traffic hindrance extends over more than three streets, a supplemental label 12 is coded and transmitted for each of the two further streets. In this embodiment, the 16-bit data field contained in label 12 is exploited in a particularly beneficial manner The present invention also relates to a method for decoding traffic messages that were coded using the method according to the present invention. In this method, in which a traffic message is provided with a location, a street, a direction, and an extent and that concerns a traffic hindrance, label 12 is interpreted such that, proceeding from the intersection of the streets coded in the traffic message, on the basis of the street coded in label 12 and in the direction indicated in label 12, and as a result of the extent indicated in label 12, the location is determined which, in the event that no further extension of the traffic hindrance is coded in label 12, indicates the end of the traffic hindrance. If the end of the traffic hindrance is not located on this street, then, in this context, it is possible to proceed such that in coding a further street in label 12, the location of the end of the traffic hindrance is read out from the location table along the further street.

DETAILED DESCRIPTION

Figures 1, 2:
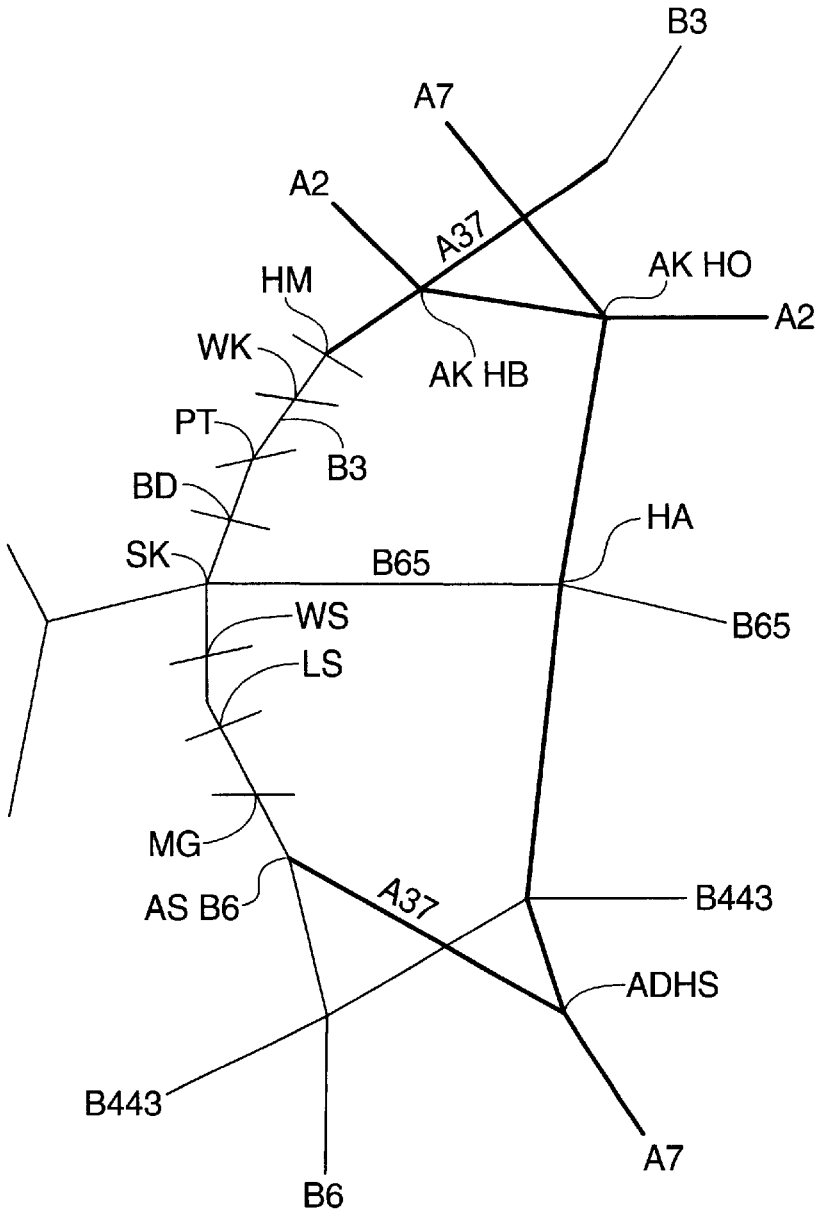
FIG. 1 depicts structure of label 12 in carrying out the method according to an embodiment of the present invention.
FIG. 2 depicts a segment of a street map to further explain the method according to an embodiment of the present invention and its advantages.

Before discussing the method according to the present invention, the coding of a traffic message in accordance with the ALERT-C protocol is explained on the basis of the example in FIG. 2. In FIG. 2, for reasons of simplicity, the names of the intersections and junctions have been abbreviated, which has been also adopted partially in the description. The map segment according to FIG. 2 shows, inter alia, autobahn A37, which begins at the three-way autobahn intersection Hannover-south AD HS, then flows into Federal highway B6. Federal highway B6 in turn, after several exits MG, LS, WS, changes at SK into B3, which then, after exits BD, PT, and WK, in Hannover-Miesburg HM feeds into autobahn A37 once again. At AK HB, this autobahn A37 intersects autobahn A2 and later autobahn A7, which travels south via AK HO, HA, and AD HS.

In addition, FIG. 2 shows segments of two further Federal highways B65 and B443. In particular, between AK HB and MG, during commercial fairs, there are frequently traffic hindrances which cannot be coded in ALERT-C without complications.

For example, if a traffic blockage in the southbound direction begins at fairgrounds exit MG and ends at the autobahn intersection Hannover-Buchholz AK HB, then in accordance with the related art, it is necessary to generate three messages, i.e., for the blockage part from the Seelhorst intersection SK to the fairgrounds, for the part of the blockage from Hannover-Miesburg HM to Seelhorst intersection [M]SK, and for the rest of the blockage from the autobahn intersection Hannover-Buchholz AK HB to Hannover-Miesburg HM. Apart from the fact that a relatively large quantity of data is required for this purpose, these three messages, which essentially belong together, are relatively difficult to understand for the user.

In the method according to the present invention, in addition to the traffic message contained in the first TMC group, label 12, depicted schematically in FIG. 1, is transmitted. The latter contains SELECT1, an information unit three bits wide, which indicates on which of the streets bordering on the intersection indicated in the primary group the traffic hindrance extends. In this context, as SELECT1, the ordinal number of the streets connected to the intersection is transmitted in counterclockwise fashion. After SELECT1, there follows a bit D1, which indicates the direction in which the traffic hindrance extends, and a four-bit-wide data word EXTENT1, which indicates the extent of the traffic hindrance on the street selected by SELECT1. Label 12 also contains data words SELECT2, D2, and EXTENT2, which similarly permit the coding of an extension of the traffic hindrance to a further intersection.

A coding of this type according to the present invention is discussed below using the example of a traffic hindrance between AK HB and MG. The primary location for the traffic message is an assumed traffic hindrance MG on B6. The first street change is at SK. Therefore, the first TMC group contains the following elements:

Location: B6, MG

Direction: positive

Extent: 3

Event: slow-moving traffic

A receiver that cannot yet interpret label 12 will translate this as: "B6 Hannover direction Laatzen between Seelhorst intersection and fairgrounds slow-moving traffic."

The final part of the traffic hindrance is coded in label 12, the elements having the values that are depicted in FIG. 1 in the lower line. At SK, B6 meets B65 and B3. The assignment of the Intersection Codes is made in accordance with ALERT-C in counter clockwise fashion: B6 SK therefore refers to B65 SK. At B65 SK, in the location table, reference B3 SK is indicated. Accordingly, B3 SK in the method according to the present invention is coded as SELECT1=2. Since the traffic hindrance extends on B3 to HM, D1=0 (positive), whereas the extent in EXTENT1=4.

From the fact that at least one of the remaining bits in label 12 is not zero, the receiver recognizes that HM is not yet the end of the traffic hindrance. Since another street intersects at HM, A37 in turn is coded as SELECT2=2. The direction is also positive, and the rest of the traffic hindrance extends only for one more segment, mainly to AK HB, for which reason EXTENT2=1. From the lack of a further label 12, the receiver recognizes that the end of the traffic hindrance has been reached. The completed message can then be transmitted as follows: "Hannover direction Laatzen between A37 AK Hannover-Anderten and B6 fairgrounds slow-moving traffic."

What is claimed is:

1. A method for encoding traffic hindrances that encroach on a street in digitally coded traffic messages which include elements of a location on a first street, an extent and a direction of the traffic hindrance, the elements being decoded using a location table, the method comprising the step of:

encoding, with respect to reported traffic hindrances that, due to their extent, extend beyond one junction onto another second bifurcating street, information concerning a second bifurcating street, a second direction, and a second extent to which the reported traffic hindrance extends in an additional element.

2. The method as recited in claim 1, wherein traffic messages are encoded digitally in accordance with the ALERT-C protocol and the additional element is a label 12.

3. A method for encoding traffic hindrances that encroach on a street in digitally coded traffic messages which include elements of a location on a first street, an extent and a direction of the traffic hindrance, the elements being decoded using a location table, the method comprising the step of:

encoding, with respect to reported traffic hindrances that, due to their extent, extend beyond one junction onto another second bifurcating street, information concerning a second bifurcating street, a second direction, and a second extent to which the reported traffic hindrance extends in an additional element, wherein traffic messages are encoded digitally in accordance with an ALERT-C protocol and the additional element is a label 12, and wherein a data field of the label 12 includes three bits for selecting the second street connected to the junction on which the traffic hindrance extends, one bit for the second direction, four bits for the second extent of the hindrance on the second street, and eight further bits for identical coding in the event that the traffic hindrance extends over a further street change.

4. The method as recited in claim 3, further comprising the step of:

encoding at least one supplemental label 12 in the event that the traffic hindrance extends over more than three streets; and transmitting the at least one supplemental label;

wherein one supplemental label is encoded and transmitted for each two further streets.

5. A method for decoding traffic messages, comprising the step of:

interpreting a label 12 in a traffic message provided with a location, a street, a direction, and an extent of a traffic hindrance, the label 12 including an encoded second street, a second direction, and a second extent, such that, proceeding from an intersection of the street encoded in the traffic message, on the basis of the second street, the second direction and the second extent encoded in the label 12, a location is determined which signifies an end of the traffic hindrance in the event that no further extension of the traffic hindrance is coded in label 12.

6. The method as recited in claim 5, wherein when a further street is encoded in the label 12, a location of the end of the traffic hindrance along the further street is read out from a location table.

* * * * *